United States Patent [19]

Schmidt

[11] 4,291,474

[45] Sep. 29, 1981

[54] DREDGE SWELL COMPENSATOR APPARATUS

[76] Inventor: Frederick J. Schmidt, 5208 N. Marietta Dr., Mobile, Ala. 36618

[21] Appl. No.: 74,379

[22] Filed: Sep. 10, 1979

[51] Int. Cl.[3] ..... E02F 3/88; E02F 3/90

[52] U.S. Cl. ..... 37/67; 37/72

[58] Field of Search ..... 37/58, 67, 72, DIG. 19, 37/DIG. 20; 172/4.5; 254/172

[56] References Cited

U.S. PATENT DOCUMENTS

| | | | |
|---|---|---|---|
| 3,151,686 | 10/1964 | Kammerer | 254/172 X |
| 3,452,207 | 6/1969 | Tsukkerman | 172/4.5 X |
| 3,462,845 | 8/1969 | Matthews | 37/DIG. 19 |
| 3,512,281 | 5/1970 | Hadjidakis | 37/58 |
| 3,797,139 | 3/1974 | Larralde | 37/67 |
| 3,841,607 | 10/1974 | Larralde et al. | 254/172 |
| 3,887,012 | 6/1975 | Scholl et al. | 37/DIG. 20 |
| 4,179,233 | 12/1979 | Bromell et al. | 254/172 X |

*Primary Examiner*—Clifford D. Crowder
*Attorney, Agent, or Firm*—Darrell E. Hollis

[57] ABSTRACT

An apparatus for maintaining a uniform grade of the surface being excavated or leveled by a waterborne dredge. The apparatus includes a shore mounted laser that projects a horizontal beam which is utilized to establish a reference plane, a dredge mounted photo receiver responsive to the beam from said shore mounted laser, a hydraulic system for repositioning the dredge cutter in response to changes of position of the dredge relative to the reference plane established by the laser beam. The hydraulic system includes a specifically designed pulley arrangement which raises and lowers the dredge ladder to maintain the cutter at a constant elevation.

6 Claims, 4 Drawing Figures

DREDGE SWELL COMPENSATOR APPARATUS

The invention described herein may be manufactured, used, and licensed by or for the Government for Governmental purposes without the payment to me of any royalties thereon.

BACKGROUND OF THE INVENTION

This invention relates to apparatus for maintaining a uniform grade of the surface being excavated or leveled by a waterborne dredge, and more particularly, to apparatus, including a laser beam—photo receiver system and a specially designed pulley arrangement, for compensating for water swell and other disturbances of waterborne dredges so as to maintain a uniform grade of the surface being excavated or leveled. Up and down movement of waterborne dredges caused by water swell or other disturbances is accentuated at the lower end of dredging ladders where the cutter action occurs. Water swell particularly effects cutters mounted on the end of barges and causes irregularities in the grade of the surface being dredged. Such irregularities may be enlarged because they interrupt streamline water flow and create localized water turbulence. Such localized water turbulence will cause scouring and depositing of sediment.

Various different mechanisms for water swell compensators in waterborne dredges and optic systems for controlling machines of the like are known in the art. Examples of such systems are disclosed in the following U.S. Pat. Nos.:

U.S. Pat. No. 2,289,242 to Chance et al discloses an optic system for controlling a motor. The system is particularly adopted for use in automatic steering systems for dirigible craft to maintain the craft on its course;

U.S. Pat. No. 2,926,437 to Ellicott, Jr. discloses a hydraulic system for raising and lowering the ladder of a waterborne dredge;

U.S. Pat. No. 3,343,810 to Parnell discloses a load compensation system that includes a hydraulic system to displace sheaves of pulleys to compensate for dynamic load changes;

U.S. Pat. No. 3,452,207 to Tuckerman discloses apparatus for controlling dredges and other machines. The apparatus includes a laser beam which provides a reference line;

U.S. Pat. No. 3,512,281 to Hadjidakis discloses apparatus for swell compensation in suction dredges. The apparatus of this invention includes activating switches on either side of a median position on a compensator plate. When the suction pipe loses contact with the riverbed, winchmotors are activated on the suction pipe suspension to make adjustments proportionate to the swell height;

U.S. Pat. No. 3,535,801 to Richter discloses hydraulic cylinders for raising and lowering the ladder of a waterborne dredge cutter;

U.S. Pat. No. 3,551,057 to Hamilton et al discloses apparatus for aligning large structures such as aircraft tooling jigs by means of a laser reference beam projected onto a light sensitive target;

U.S. Pat. No. 3,588,249 to Studebaker discloses surveying apparatus that includes a laser beam for establishing a survey reference plane;

U.S. Pat. No. 3,649,122 to Haltz discloses apparatus which includes a laser beam—photoelectric system for measuring coordinates and differences in terrain height relative to a reference point;

U.S. Pat. No. 3,734,564 to McKay et al discloses a dredge having swell compensating means that includes a block and tackle system that responds to sonic sensing means;

U.S. Pat. No. 3,777,376 to Treine et al discloses apparatus using hydraulic lift compensators which are actuated by pressure on the bucket or cutter from the floor;

Similarly, U.S. Pat. No. 3,797,139 to Larralde also discloses lift compensators that respond to the relative pressure on the bucket or cutter from the floor;

U.S. Pat. No. 3,893,249 to Wolters discloses dredging apparatus that uses a cable length varying lever to maintain constant pressure;

U.S. Pat. No. 3,948,486 to Jourdan et al discloses a hydraulic block and tackle system to compensate for movement caused by swells; and U.S. Pat. No. 3,949,496 to de Koning et al discloses dredge apparatus that responds to cable pressure and provides a cable length variation to maintain constant pressure.

This invention represents an improvement over the prior art waterborne dredge compensator systems. The system of this invention responds very quickly to raise and lower the ladder in response to movement by the dredge and includes an A-frame, hydraulic lifter and a specifically designed block and tackle assembly for support and control of the cutter ladder to maintain the cutter at a constant elevation.

SUMMARY OF THE INVENTION

This invention provides for continuous compensation of waterborne dredge cutters in order to maintain a uniform grade of the surface being excavated or leveled. Water swell and wave disturbances lift, heave and turn waterborne dredges. This lifting, turning and heaving will result in grade irregularities in the surface being excavated or leveled by the dredge cutter. Such bottom irregularities may subsequently be enlarged because they interrupt streamline water flow in water courses and create localized water turbulence with attendant depositing of sediment and scouring.

The apparatus of this invention includes a shore mounted laser. The laser projects a horizontal beam which establishes the reference plane. A photo receiver made up of an array of photo sensitive devices is mounted on the dredge. This photo receiver communicates with the laser beam and if the dredge moves relative to the reference plane, the photo receiver provides an output signal indicative of the position of the dredge relative to the reference plane. When the dredge is in the reference plane established by the laser beam, the photo receiver does not provide an output signal. Any output signals from the photo receiver activate a hydraulic system that, depending upon the control signal from the photo receiver, either raises or lowers the ladder by means of a specifically designed block and tackle arrangement to maintain the dredge cutter at a constant elevation.

BRIEF DESCRIPTION OF THE DRAWING

A complete understanding of the invention can be obtained from the following detailed description when read in conjunction with the annexed drawing in which.

DETAILED DESCRIPTION OF THE INVENTION

Figure 1:
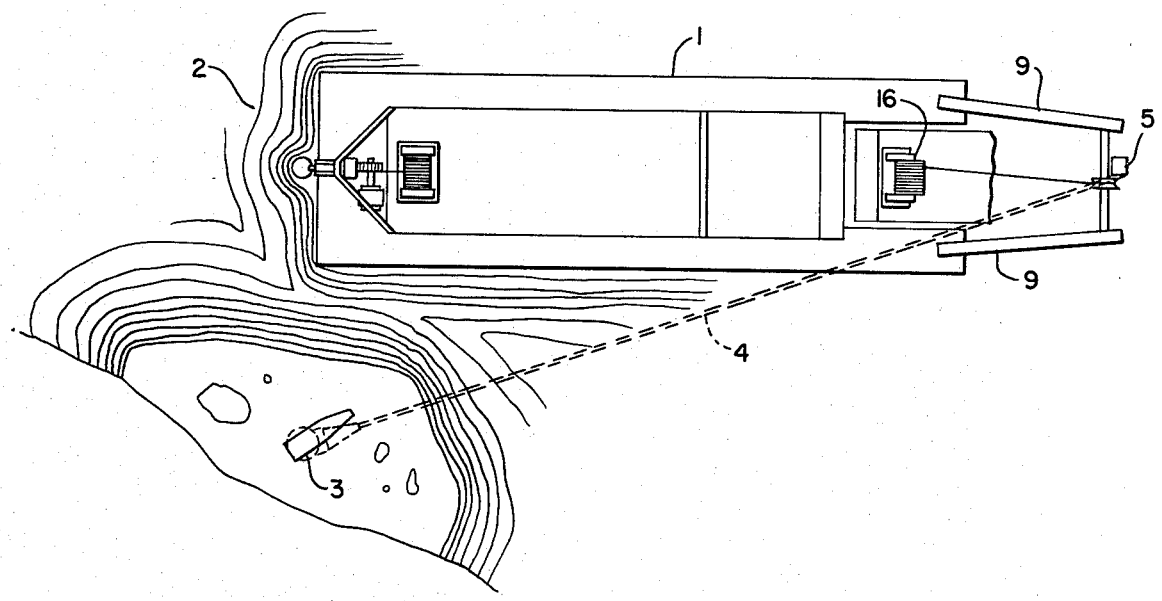
FIG. 1 illustrates an operational configuration of the compensation system of the invention.

Referring to FIG. 1, this figure shows a waterborne dredge 1 floating on a body of water 2. Dredge 1 is to be operated to excavate or level the bottom surface of the body of water 2. A laser 3 is mounted on shore. Laser 3 projects a horizontal beam 4 that communicates with a photo receiver 5 mounted on dredge 1. The horizontal beam 4 projected by laser 3 establishes a reference plane.

Figure 2:
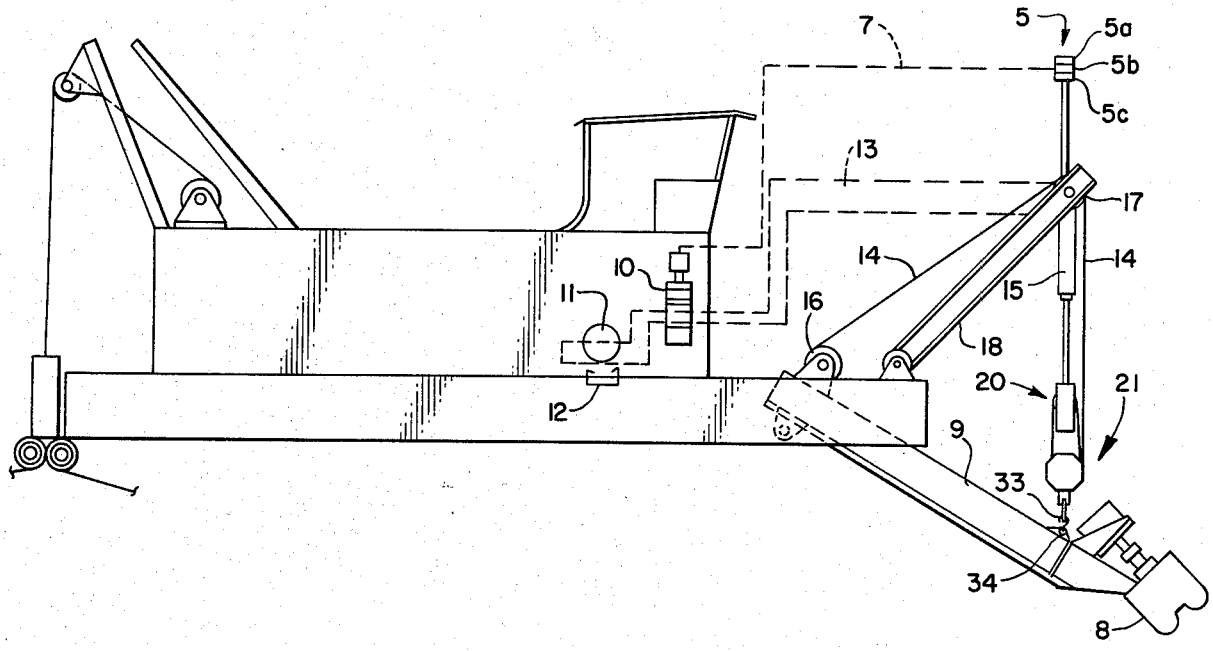
FIG. 2 is a view in elevation illustrating the dredge mounted apparatus of this invention.
Figure 4:
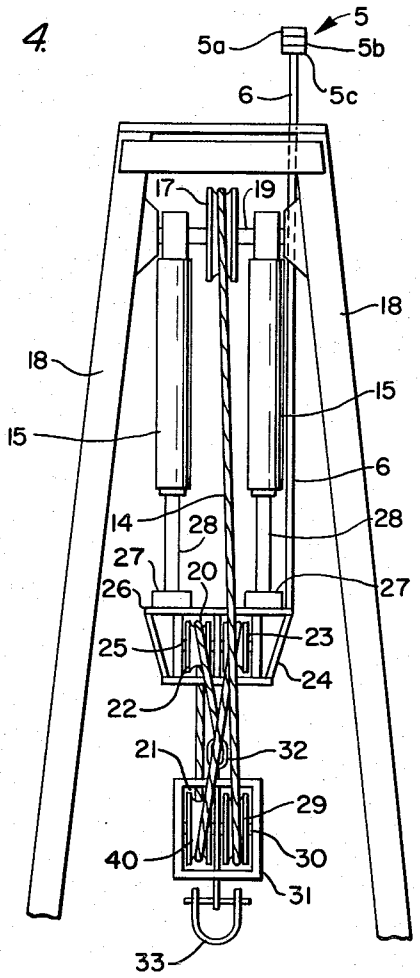
FIG. 4 is a front view showing the details of the block and tackle arrangement of the invention.
Figure 3:
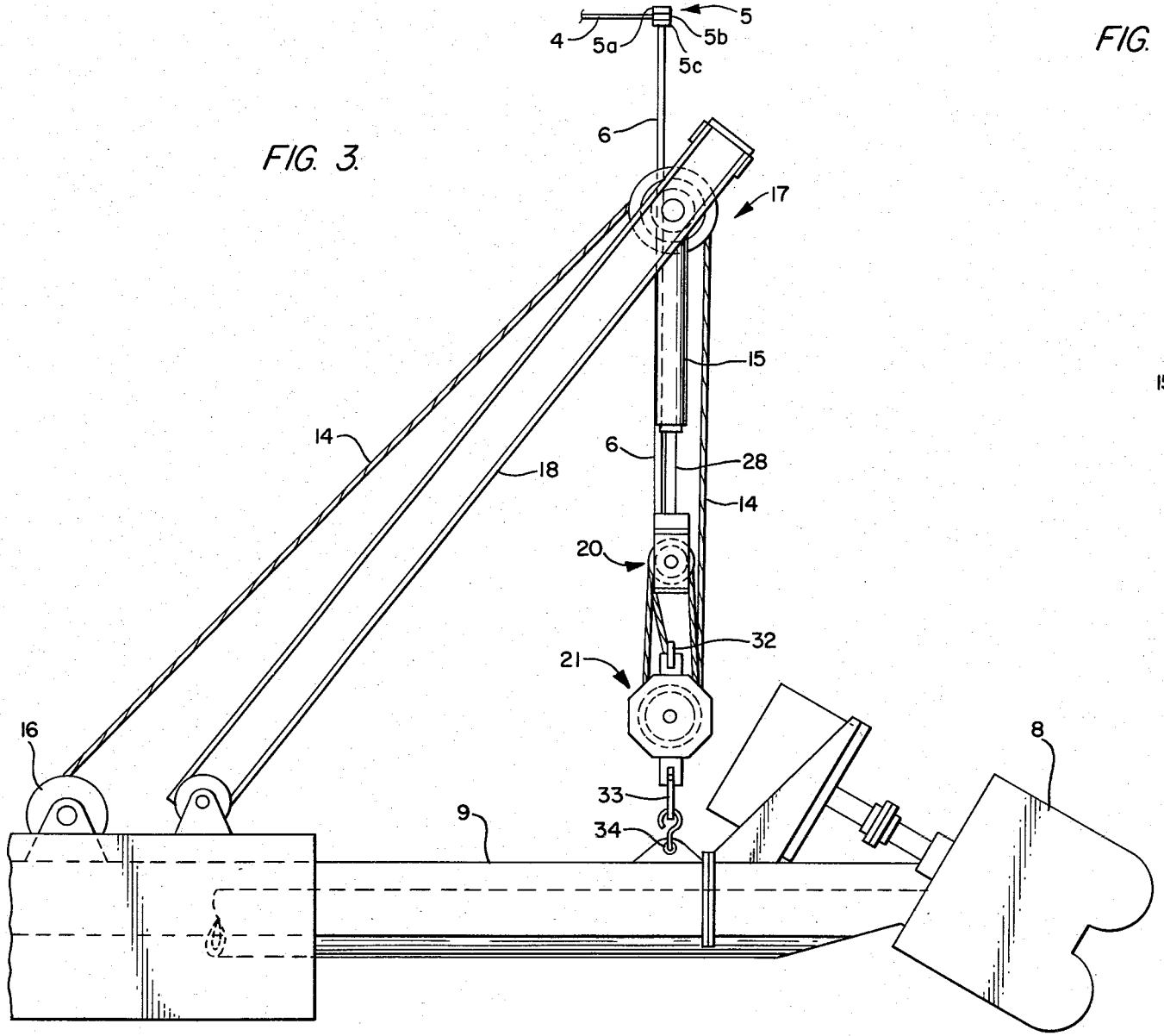
FIG. 3 is a side view showing the details of the block and tackle arrangement of this invention.

Referring to FIGS. 2, 3 and 4 photo receiver 5 includes at least three photo sensitive arrays vertically arranged. The photo sensitive array 5*a* is the uppermost array, the photo sensitive array 5*c* is the lowermost array and the photo sensitive array 5*b* is the center array. Each one of the photo sensitive arrays 5*a*, 5*b* and 5*c* are made up of a plurality of photo cells or preferably a plurality of photo diodes. Since photo receiver 5 communicates with laser beam 4, it is mounted on the rod 6 which extends above the remainder of the apparatus.

When laser beam 4, which is a continuous beam of radiant energy, impinges on central photo sensitive array 5*b*, there is zero current flow in the electrical circuit 7. As long as laser beam 4 impinges on photo sensitive array 5*b*, the dredge cutter 8 is at the desired elevation.

In FIG. 2, the hydraulic system and electrical system are not shown in any details. The electrical circuit 7 is shown as a dotted line. Similarly, the hydraulic lines 13 are shown as dotted lines. When the hydraulic system is activated by electrical circuit 7, the proportioning valve 10 directs a hydraulic fluid from the storage tanks 12 through the pump 11 and then through hydraulic lines 13 to hydraulic cylinders 15 to raise or lower the ladder 9; thereby raising or lowering the cutter 8. The details of the hydraulic system and electrical system per se are not shown in detail because such systems are conventional wellknown systems.

When barge 1 drops, due to a trough, for example, photo receiver 5 will also drop. When photo receiver 5 drops, laser beam 4 will impinge on photo sensitive array 5*a*. When laser beam 4 impinges on photo sensitive array 5*a*, photo receiver 5 generates a signal that activates the hydraulic system to raise ladder 9, and therefore, cutter 8. The hydraulic system will continue to raise ladder 8 until laser beam 4 again impinges on photo sensitive array 5*b*.

If on the other hand, barge 1 is elevated by a wave, for example, laser beam 4 will impinge on photo sensitive array 5*c*. When laser beam 4 impinges on photo sensitive array 5*c*, photo receiver 5 produces an output signal that activates the hydraulic system to lower ladder 9, and therefore cutter 8. Ladder 9 is lowered until such time that laser beam 4 again impinges on photo sensitive array 5*b*.

Summarizing, when cutter 8 is at the desired elevation as determined by laser beam 4, laser beam 4 impinges upon photo sensitive array 5*b* and the compensating system of this invention is quiescent. When laser beam 4 impinges on photo sensitive array 5*a*, the hydraulic system is activated to raise ladder 9 and thus cutter 8 until laser beam 4 again impinges on photo sensitive array 5*b*. If laser beam 4 impinges on photo sensitive array 5*c*, the hydraulic system is activated to lower ladder 9 and thus cutter 8 until laser beam 4 again impinges on photo sensitive array 5*b*.

FIGS. 3 and 4 illustrate an important feature of the compensation system of this invention. More specifically, FIGS. 3 and 4 show the details of the pulley assembly, the manner in which the wire rope 14 is threaded on the pulleys, the mounting of photo receiver 5 and the mounting of the hydraulic cylinders 15. Wire 14 is wrapped around the winch 16 and extends upward at an angle and over the large pulley or sheave 17. Pulley 17 is mounted on the pin 19 which is supported by the A-frame 18. The upper end of one of the hydraulic cylinders 15 is mounted on pin 19 on one side of pulley 17 and the upper end of the other hydraulic cylinder 15 is mounted on pin 19 on the other side of pulley 17.

In addition to large sheave 17, the block and tackle arrangement includes a small upper pulley block 20 and a smaller lower pulley block 21. Pulley block 20 includes a first pulley 22 and a second pulley 23. Pulleys 22 and 23 are mounted in a housing 24 having extensions on both sides. Pulleys 22 and 23 are mounted on the pin 25 which is supported by housing 24. Internal bearings, not shown, are provided. Internal bearings are also provided for pin 19.

Housing 24 includes a flat horizontal upper plate 26. The cylindrical fittings 27 are mounted on plate 26 adjacent each end. The lower end of extensible 28 rod of one of the hydraulic cylinders 15 is secured inside one of the fittings 27 and the lower end of extensible rod 28 of the other hydraulic cylinder 15 is secured inside the other fitting 27. The lower end of support rod 6 is also secured to plate 26. As previously mentioned, photo receiver 5 is mounted on top of support rod 6.

Lower pulley block 21 includes a first pulley 40 and a second pulley 29. Pulleys 40 and 29 are mounted on the pin 30 which is supported by the housing 31. Again, internal bearings, not visible in the drawing, are provided. A ring 32 is secured to the top of housing 31 and a U-ring is secured to the bottom of housing 31. U-ring 33 is secured to ladder 9 by means of the eyelet 34 (FIG. 3).

As shown in FIG. 1, ladder 9 has two arms. The bottom end of the legs of A-frame 18 is secured to the barge in the manner shown in FIGS. 2 and 3.

After wire rope 14 passes through pulley 17, it extends downward through pulley 29 of lower pulley block 21, up through pulley 23 of upper pulley block 20, down through pulley 40 of lower pulley block 21, and then up through pulley 22 of upper pulley block 20. After wire rope 14 passes through pulley 22, this end of wire rope 14 is secured to ring 32.

With this block and tackle arrangement, wire rope 14 from winch 16 always goes through large sheave 17 mounted in A-frame 18 and upper and lower pulley blocks 20 and 21 respectively move vertically upon command from the laser beam 4 and photo receiver 5 to raise and lower ladder 9 and therefore cutter 8.

Extensible rods 28 of hydraulic cylinders retract in unison when ladder 9 is to be raised and extend in unison when ladder 9 is to be lowered. Plate 26 always remains horizontal in that upper and lower pulley blocks 20 and 21 move up and down vertically. Further, since support rod 6 which supports photo receiver 5 is also mounted on plate 26, photo receiver 5 moves up and down in direct relationship with the movement of pulley block 20 and thus ladder 9. In addition, since wire rope 14 always passes through upper sheave 17, there is no danger that wire rope 14 will strike an obstruction in the A-frame or some other object.

From the foregoing description of the operation of the block and tackle system of this invention and the relationship of photo receiver 5 with respect to the movement of upper and lower pulley blocks 20 and 21, it should be obvious that ladder 9 and thus cutter 8 move up and down in direct relationship to the command from photo receiver 5. When pulley blocks 20 and 21 move up and down, photo receiver 5 moves up and down in direct relationship to the movement of pulley block 20. Thus, any vertical movement of ladder 9 is directly related to the vertical movement of photo receiver 5 and therefore, cutter 8 is maintained at the desired elevation to obtain a continuous uniform grade.

While the invention has been described with reference to a specific embodiment, it will be apparent to those skilled in the art that various changes or modifications can be made to this embodiment without departing from the spirit and scope of the invention as set forth in the claims.

What is claimed is:

1. A waterborne dredge compensating system for maintaining a uniform grade comprising:

a. a shore mounted laster for projecting a horizontal beam of radiant energy, said horizontal beam establishing a reference plane of known elevation;

b. a photo receiver having a plurality of vertically arranged photo sensitive arrays, said photo receiver being mounted on a waterborne dredge and being so oriented that said horizontal beam of radiant energy impinges on said photo receiver;

c. a dredge ladder having one end mounted on said waterborne dredge such that said ladder is vertically moveable and having a dredge cutter mounted on its other end;

d. a hydraulic system, activated by output signals from said photo receiver, mounted on said waterborne dredge;

e. a winch mounted on said dredge;

f. an A-frame, mounted on said waterborne dredge, supporting a block and tackle assembly, said block and tackle assembly including a first pulley block having a flat horizontal upper plate; and g. a vertical support rod, said vertical support rod having its bottom end secured to said flat horizontal upper plate of said first pulley block and wherein said photo receiver is secured to the top end of said vertical support rod, whereby said photo receiver moves up and down when said first pulley block moves up and down, respectively.

2. The apparatus of claim 1 wherein said block and tackle further includes:

a. a pin mounted on said A-frame;

b. a large upper pulley mounted on said pin, said first pulley block being suspended below said large upper pulley; and c. a second pulley block suspended below said first pulley block.

3. The apparatus of claim 2 wherein said hydraulic system includes:

a. a first hydraulic cylinder having a first end mounted on said pin secured to said A-frame adjacent one side of said large upper pulley and a second end secured to said flat horizontal upper plate of said first pulley block; and b. a second hydraulic cylinder having a first end mounted on said pin secured to said A-frame adjacent the other side of said large upper pulley and a second end secured to said flat horizontal upper plate of said first pulley block.

4. A waterborne dredge compensating system for maintaining a uniform grade comprising:

a. a shore mounted laser for projecting a horizontal beam of radiant energy, said horizontal beam establishing a reference plane of known elevation;

b. a photo receiver having three photo sensitive arrays mounted one on top of the other, said photo receiver being mounted on a waterborne dredge and being so oriented that said horizontal beam of radiant energy impinges on said photo receiver, said photo receiver produces an output signal when said laser beam impinges on the uppermost one of said three photo sensitive arrays, produces an output when said laser beam impinges on the lowermost one of said three photo sensitive arrays and produces no output signal when said laser beam impinges on the center one of said three photo sensitive arrays;

c. a dredge ladder having one end mounted on said waterborne dredge such that said ladder is vertically moveable and having a dredge cutter mounted on its other end;

d. a hydraulic system, activated by output signals from said photo receiver, mounted on said waterborne dredge;

e. a winch mounted on said dredge; and f. an A-frame, mounted on said waterborne dredge, supporting a block and tackle assembly, said block and tackle assembly including a first pulley block having a flat horizontal upper plate.

5. The apparatus of claim 4, wherein said block and tackle further includes;

a. a pin mounted on said A-frame;

b. a large upper pulley mounted on said pin, said first pulley block being suspended below said large upper pulley; and c. a second pulley block suspended below said first pulley block.

6. The apparatus of claim 5 wherein said hydraulic system includes:

a. a first hydraulic cylinder having a first end mounted on said pin secured to said A-frame adjacent one side of said large upper pulley and a second end secured to said flat horizontal upper plate of said first pulley block; and b. a second hydraulic cylinder having a first end mounted on said pin secured to said A-frame adjacent the other side of said large upper pulley and a second end secured to said flat horizontal upper plate of said first pulley block.

* * * * *